United States Patent [19]

Bond

[11] 4,362,255

[45] Dec. 7, 1982

[54] BARRIER SPOUT AND CAP FOR FLEXIBLE BAGS OR POUCHES

[75] Inventor: Curtis J. Bond, Marion, Ohio

[73] Assignee: Liqui-Box Corporation, Worthington, Ohio

[21] Appl. No.: 200,528

[22] Filed: Oct. 24, 1980

[51] Int. Cl.[3] ..... B65D 39/04

[52] U.S. Cl. ..... 222/107; 220/358; 222/542; 222/563

[58] Field of Search ..... 222/107, 212, 215, 541, 222/542, 552, 554, 563; 220/357, 358; 215/364

[56] References Cited

U.S. PATENT DOCUMENTS

| | | | |
|---|---|---|---|
| 1,037,272 | 9/1912 | Lindsay | 215/364 X |
| 3,093,274 | 6/1963 | Galbierz | 222/541 |
| 3,260,411 | 7/1966 | Dobson | 222/107 |
| 3,618,814 | 11/1971 | Nagroski | 220/358 |
| 3,760,969 | 9/1973 | Shimamoto et al. | 215/364 X |
| 4,132,331 | 1/1979 | Magerle | 222/107 |
| 4,280,634 | 7/1981 | Wiesenberger et al. | 222/541 X |

*Primary Examiner*—F. J. Bartuska

*Attorney, Agent, or Firm*—William V. Miller

[57] ABSTRACT

A barrier spout and cap assembly mounted on a flexible bag or pouch of plastic laminate film having barrier material incorporated therein to prevent the permeation of various gases and especially oxygen. The structures of the spout and its cooperating removable and replaceable cap are such that they provide a barrier to gas permeation at the joint between the spout and bag and through the cap. The cap and associated barrier are removeable and replaceable to facilitate filling of the bag.

9 Claims, 10 Drawing Figures

BARRIER SPOUT AND CAP FOR FLEXIBLE BAGS OR POUCHES

BACKGROUND AND SUMMARY OF THE INVENTION

At the present time, it is customary to pack various perishable products in flexible bags or pouches of plastic having an attached spout with which a removable and replaceable cap cooperates, the filling of the bag usually being accomplished after removing the cap which is then replaced to seal the bag. The plastic bag is usually made of a polylaminate which includes a barrier film composite that prevents the permeation of gases, especially oxygen, which would tend to spoil the contents. However, although the bag material itself has included the gas barrier, there is gas penetration through the spout and cap assembly within the seal between the external flange of the spout and bag and even through the spout and cap material itself which is usually of polyethylene but may be of other plastics. It is not uncommon for the permeation rate through the spout and cap assembly to be six times the rate of permeation through the entire remaining surface area of a four liter bag or pouch.

The present invention substantially reduces the penetration of oxygen or other gases through the spout and cap assembly by providing a barrier film or coating to the flange of the spout from where it is sealed to the bag and inwardly to a point overlapping a cooperating barrier film extending transversely completely across the cap. However, the arrangement is such that the cap is removable for filling and can then be replaced to become in combination with the spout substantially an impermeable assembly.

BRIEF DESCRIPTION OF THE DRAWINGS

The best mode contemplated in carrying out this invention is illustrated in the accompanying drawings in which.

DETAILED DESCRIPTION OF THE INVENTION

Figure 1:
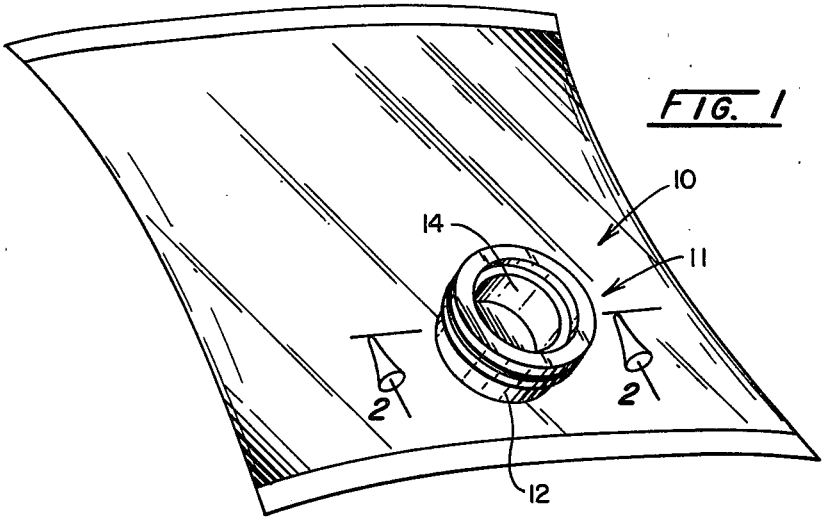
FIG. 1 is a perspective view of a flexible bag having a barrier spout and cap assembly according to this invention.

With specific reference to the drawings, in FIG. 1 there is illustrated, as an example of the application of this invention, a flexible bag or pouch 10 which is made of flexible plastic material, such as a polylaminate including at least one barrier layer or film which will substantially reduce the permeation of gases, such as oxygen, which would tend to spoil the bag contents. One such laminate, which is in common use, consists of one or more layers of ethyl vinyl acetate copolymer and a barrier layer or film of metallized polyester. Many other barriers are used, such as foil, polysaran, metallized nylon, or polyester, etc.

Figure 2:
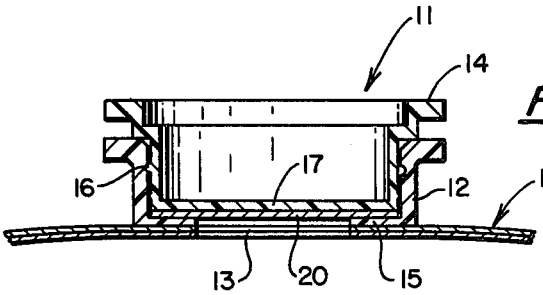
FIG. 2 is a transverse sectional view taken along line 2—2 FIG. 1 through the spout and cap assembly.

In FIG. 2, the material of the bag 10 is shown as being of two layers of material but, as indicated above, this can be any number of layers including at least one barrier layer or coating.

The bag 10 is provided with a fitment in the form of a barrier spout and cap assembly according to this invention, which is indicated generally by the numeral 11. This assembly consists of a spout 1 which is attached to the bag, around a suitable opening 13, and a removable cap 14 which serves to seal the spout when it is applied thereto. The cap is usually removed for filling the bag.

The spout and cap for bags or pouches of this general type are usually made from semi-rigid plastic material, such as polyethylene, which is pervious to the penetration of gases, such as oxygen, which tends to spoil the contents of the bag. According to this invention, the spout and cap assembly 11 is constructed to include a barrier coating or film which cooperates with the barrier coating or film of the polylaminate bag 10 to prevent the penetration of gases into the bag within the joint between the bag material and spout or through either the cap or the spout itself.

Figure 3:
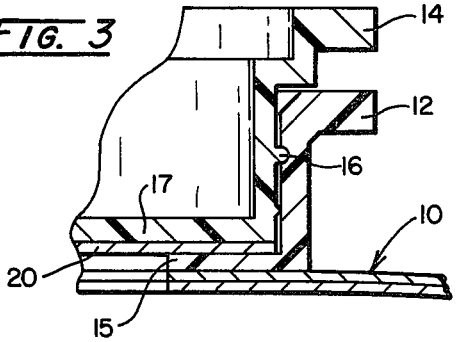
FIG. 3 is an enlarged sectional view showing how the gas barrier carried by the cap cooperates with the barrier material of the bag.
Figure 4:
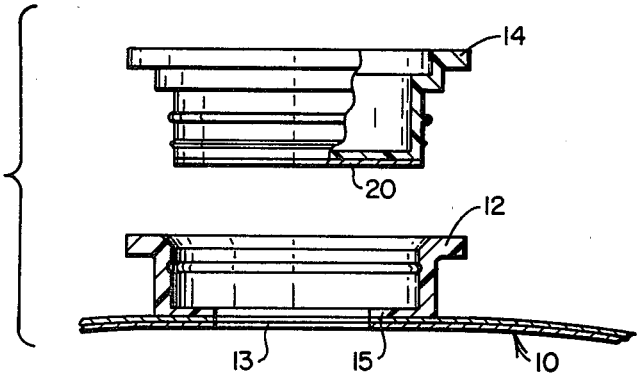
FIG. 4 is a view, partly in side elevation and partly in section, showing the cap separated from the spout.

Thus, in FIGS. 2 to 4, the tubular spout 12 is provided with a radially inwardly directed, continuous, annular attaching flange 15 formed at the lower edge thereof. This flange is heat-sealed to the laminate material 10 of the bag. It will be noted from FIGS. 2 and 3 that the laminate material 10 extends beneath the flange 15 to the edge of the opening 13.

A removable cap 14 is provided for mounting on the spout 10 to seal it. This cap may be of cup-like tubular form and is adapted to be telescoped downwardly within the tubular spout 12. A releasable friction locking means may be provided at 16 in the form of a cooperating annular shoulder and groove. The disc-like bottom 17 of the cap 14 is provided with a barrier film layer or coating 20 which may be the same or different from the barrier in the bag material 10. Thus, it may be a metallized polyester, polyvinyladine chloride, metallized nylon, metal film, etc. This film or coating 20 thus forms a barrier extending completely across the cap 14. When the tubular cap 14 is inserted in the tubular spout 12 and snapped into position to lock it, the barrier coating 20 at the lower disc-like end thereof will rest and seal on the inwardly-directed flange 15 of the spout. Thus, the barrier material 20 of the cap will overlie the barrier material of the bag laminate 10 and will serve to prevent gas penetration at this point. In addition, since the barrier 20 extends transversely completely across the lower end of the cap, gases which penetrate through the tubular walls of the spout and cooperating cap cannot reach the interior of the bag 10. The cap 12 is usually withdrawn from the spout for the filling operation, as indicated in FIG. 4, but is readily replaceable to the condition of FIG. 2 where its barrier material 20 overlaps the barrier material of the bag 10.

Figure 5:
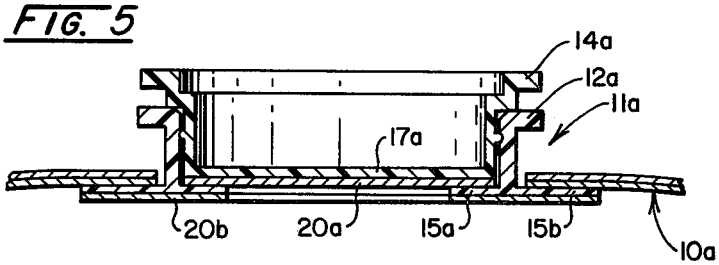
FIG. 5 is a view similar to FIG. 2 but showing a modification of the spout and cap assembly with barrier.
Figure 6:
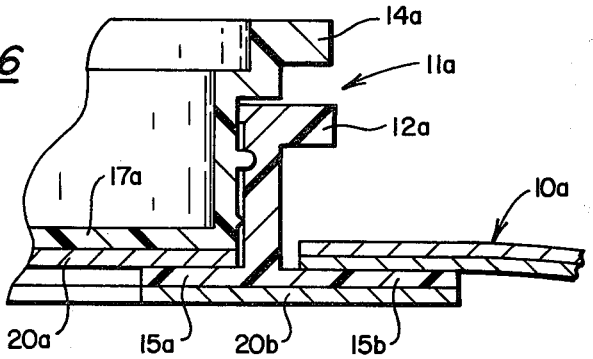
FIG. 6 is an enlargement of a portion of the spout and cap assembly of FIG. 5.

In FIGS. 5 and 6, another application of this invention is illustrated. A cap and spout assembly 11*a* is indicated in these Figures and again includes a gas barrier arrangement that cooperates with the barrier material of the bag 10*a* to prevent permeation of gas, such as oxygen, into the bag at the joint where the spout 11*a* is connected to the bag and through the spout 12*a* itself or the cooperating cap 14*a*.

In this example, the cap 14*a* is formed substantially as before with a tubular body and a transversely extending lower or bottom wall 17*a*. This bottom wall 17*a* carries on its lower surface, the barrier film or coating 20*a* as before.

However, the spout 12*a* is formed differently, in that it has, at the lower side of its tubular body, a double flange which extends both radially inwardly and outwardly. Thus, an annular inwardly projecting flange 15*a* and an annular outwardly projecting peripheral flange 15*b* are provided. The inner flange 15*a* terminates at the opening 13*a* and the outer flange 15*b* extends substantially outwardly from the tubular body of the spout 12*a* so that the bag material 10*a* can be heat-sealed thereto. However, the polylaminate material 10*a*, with barrier, is heat-sealed to the upper surface of the spout flange rather than to the lower surface thereof as is done at present in the art. To prevent passage of gas through the double flange, its lower surface is completely covered with an annular barrier film or coating 20*b*.

With this arrangement, when the cap 14*a* is inserted in the body of the spout 12 and is snapped into its final position, resting on flange 15*a*, the barrier film or coating 20*a* of the cap will overlie the barrier film or coating 20*b* beneath the inwardly projecting flange 15*a*. Also, the edge of the material 10*a*, including the barrier, is heat-sealed to the upper surface of the outwardly-projecting flange 15*b* and will overlie the barrier film or coating 20*b* on the lower surface of the flange.

Figure 7:
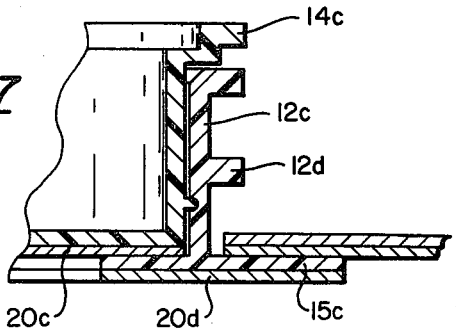
FIG. 7 is a view similar to FIG. 6 showing an extended version of the spout and cap assembly.

Thus, with this arrangement, the bag material 10*a* is heat-sealed to the attaching flange of the spout 17*a*, but this flange is modified to include the inwardly projecting flange portion 15*a* upon which the cap 14*a* rests and seals. The lower surface of the entire double flange is provided with the barrier film or coating 20*b* to cooperate, respectively, with the barrier in the bag material 10*a* and the barrier film or coating 20*a* on the bottom of the cap. Thus, gas penetration will be precluded at the seal between the bag and spout and between the spout and cap. In FIG. 7 an extended version of the assembly is shown which includes a deeper spout and cap. Spout 12*c* is of greater axial extent to receive deeper cap 14*c*. The remaining structure is substantially the same as in FIG. 6, including the barrier 20*c* on the cap and barrier 20*d* on the double flange 15*c*. However, an additional peripheral flange 12*d* is provided intermediate the extent of the spout which is desirable in some instances in handling the spout.

Figure 8:
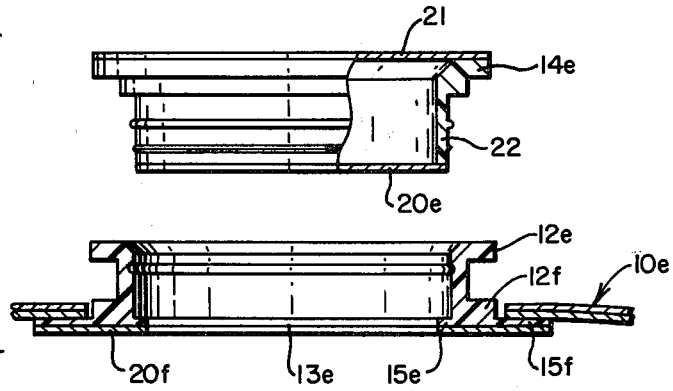
FIG. 8 is a view similar to FIG. 4 showing another modification of the assembly.
Figure 9:
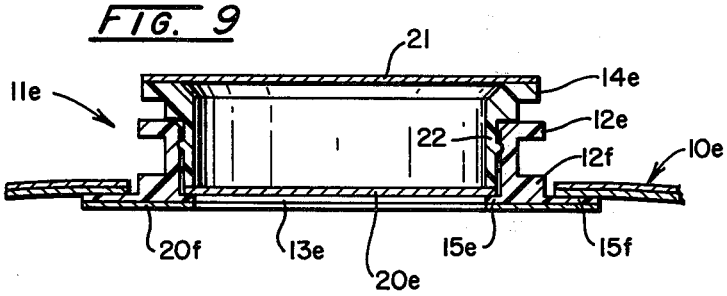
FIG. 9 is an axial sectional view of the assembly of the cap and spout of FIG. 8.
Figure 10:
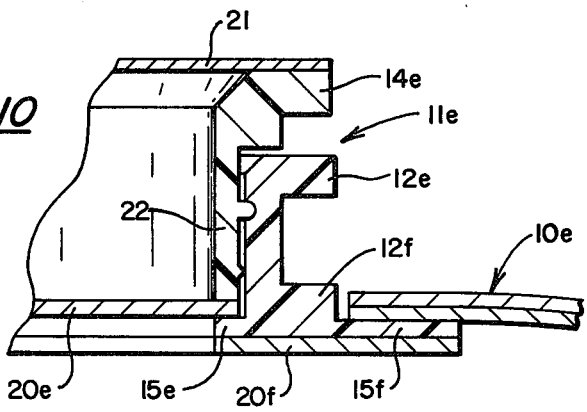
FIG. 10 is an enlarged sectional view of part of the assembly FIG. 9.

FIGS. 8, 9 and 10 illustrate a version of the spout and cap assembly which is particularly suitable for mounting on a dispenser of the type now commonly in use and which is of such a nature that it can readily receive a dispenser valve with a probe or tube or be connected to a dispensing pump or the like. In this assembly 11*e*, the spout is indicated at 12*e* and the removable cap at 14*e*.

The spout 12*e* is shown substantially the same as spout 12*a* of FIGS. 4 to 6 except it is shaped slightly different on its exterior to provide an additional lip or flange 12*f*. This annular flange 12*f* is spaced axially from the annular exterior flange 12*e* to provide an annular groove which will permit mounting of a dispensing valve thereon or insertion of the spout into a retaining means on the dispenser or connection to a dispensing pump, the lip 12*f* preventing contact with the adjacent bag material 10*e*. It will be apparent that the spout 12*a* and the spout 12 could be provided with this additional retaining flange or lip, if desired. The spout 12*e* has the double flange at its lower edge which includes the inwardly-directed annular flange 15*e*. The entire lower surface of the double flange, as before, is covered with the barrier film or coating 20*f* which extends to the edge of the opening 13*e*.

The cap 14*e* is similar to the cap 14*a* but does not have the integral disc-like bottom 17*a*. Instead, the body 22 is merely of tubular form with open upper and lower ends to provide a clear passage therethrough. The lower edge of tube 22 has sealed thereto, a barrier disc or diaphragm 20*e* and the upper edge thereof has sealed thereto a dust disc 21 which may or not be barrier material, but in either instance will keep the interior of tube 22 dust-free and sanitary. When the tubular cap 14*e* is inserted in the tubular spout 12*e* and snapped into position, the barrier disc 20*e* will rest on the annular shoulder 15*e* as shown in FIGS. 9 and 10. It will be noted that the inner edge of shoulder 15*e* is substantially flush with the inner surface of the tube 22 so that opening 13*e* is at least as large as the passage through tube 22. However, it will further be noted that the edge of barrier disc 20*e* overlaps the edge of barrier material 20*f* under the shoulder or flange 15*e*.

Assuming the bag is filled by first removing and replacing the cap 14*e* and the spout 12*e*. The bag may be mounted in a dispenser by means of annular flanges 12*e* and 12*f*. The outer disc 21 is preferably physically removed and a probe is inserted into the exposed opening and pushed inwardly to rupture disc 20*e* or the probe can be pushed through both the discs 21 and 21*e*. Since flange or shoulder 15*e* does not project inwardly beyond the thickness of tube 22, it will not interfere with insertion of the probe. The opening 13*e* will be at least as large as the passage through the tube 22 of the cap to permit free passage of the probe. The probe could be on a valve or a tube which may lead to a dispensing pump. Thus, this assembly is of such a nature as to facilitate mounting of a dispenser valve thereon or mounting it on a dispenser unit and the connection of the spout to the dispensing pump thereof.

It will be apparent from the above that this invention provides a barrier spout and cap assembly which can be heat-sealed to the bag laminate that includes a barrier to the penetration of gas. The assembly is provided with a barrier film or coating that is applied in such a manner as to substantially reduce penetration of gas through the attaching flange of the spout as well through the cap and the spout. This results from the arrangement, in each instance, providing a barrier substance extending completely across the opening in the barrier bag material, which receives the spout, and the associated attaching flange of the spout, but which does not affect the removability of the cap for filling and its replacement for sealing.

Having thus described the invention, what is claimed is:

1. A flexible bag formed of a laminate including a gas barrier layer having a spout and cap assembly mounted thereon in association with a filling and dispensing opening, said assembly comprising a tubular spout and a removable and replaceable sealing cap mounted thereon, said spout having an attaching flange which is heat-sealed to said bag laminate with said flange carrying a gas barrier layer, said cap carrying a transversely extending gas barrier layer which extends completely across said opening and overlaps said barrier layer on the attaching flange; said spout and cap being plastic, said spout comprising a tubular body with its attaching flange thereon, and said cap comprising a tubular body with a lower closed end which carries said barrier layer, said cap having its tubular body inserted in said spout tubular body with its barrier layer overlapping said flange; said attaching flange extending radially inwardly and the bag laminate extending beneath said flange and being heat-sealed thereto, said cap having a lower transverse wall which carries its barrier layer on its lower surface and which is positioned in contact with the upper surface of said flange.

2. A flexible bag formed of a laminate including a gas barrier layer having a spout and cap assembly mounted thereon in association with a filling and dispensing opening, said assembly comprising a tubular spout and a removable and replaceable sealing cap mounted thereon, said spout having an attaching flange which is overlapped by said bag laminate that is heat-sealed thereto with said flange carrying a gas barrier layer, said cap carrying a transversely extending gas barrier layer which extends completely across said opening and overlaps said barrier layer on the attaching flange; said spout and cap being of plastic; said spout comprising a tubular body with its attaching flange thereon, and said cap comprising a tubular body with a lower closed end which carries said barrier layer, said cap having its tublar body inserted in said spout tubular body with its barrier layer overlapping said flange; said attaching flange being a double flange having an inner portion which extends radially inwadly and an outer portion which extends radially outwardly, the bag laminate extending over the outwardly extending flange portion and being heat-sealed thereto, said double flange having its barrier layer covering its lower surface, said cap having a flat lower transverse wall which carries its barrier layer and which is positioned in contact with the upper surface of the inwardly extending flange portion.

3. A flexible bag according to claim 1 or 2 in which means is provided for locking said cap in position in the spout with its barrier layer in sealing contact with said flange.

4. A flexible bag formed of a laminate including a gas barrier layer having a spout and cap assembly mounted thereon in association with a filling and dispensing opening, said assembly comprising a tubular spout and a removable and replaceable sealing cap mounted thereon, said spout being attached to the laminate, said cap carrying a transversely extending gas barrier layer which extends completely across said opening; said cap being tubular to provide a passage therethrough and the barrier layer being in the form of a rupturable disc attached to the lower extremity thereof; said spout being attached to the laminate by a double flange at its lower edge which is heat-sealed thereto, said double flange including an inwardly projecting stop flange portion with which the barrier disc contacts, the opening within the stop flange being at least as large as the passage through the cap to permit insertion of a probe or the like, said double flange also including an outer portion heat-sealed to the laminate, said double flange having a barrier layer covering its entire lower surface so that it is overlapped by the barrier disc and the laminate.

5. A flexible bag according to claim 4 in which a rupturable sealing disc is attached to the outer extremity of the tubular cap to seal the passage therethrough.

6. A flexible bag according to claim 5 in which the outer portion of the flange has a lip around which the laminate is disposed and which is of greater depth than the thickness of the laminate, said spout having another flange axially outwardly of said lip to provide a groove therebetween.

7. A flexible bag according to claim 6 in which means is provided for locking said cap in position in the spout with said barrier disc in contact with said stop flange portion.

8. A flexible bag according to claim 4 in which the spout is provided with an attaching flange including an outwardly projecting portion over which the laminate extends and is heat sealed thereto, said flange having a lip on its upper surface surrounded by the laminate and being of greater depth than the thickness of the laminate, said spout also having an additional outwardly extending flange axially outwardly of said lip, to provide a groove therebetween.

9. A flexible bag formed of a laminate including a gas barrier layer having a spout and cap assembly mounted thereon in association with a filling and dispensing opening, said assembly comprising a tubular spout and a removeable and replaceable sealing cap mounted thereon, said spout having an attaching flange which is heat-sealed to said bag laminate with said flange carrying a gas barrier layer, said cap carrying a transversely-extending gas barrier layer which extends completely across said opening and overlaps said barrier layer on the attaching flange; said spout and cap being plastic, said spout comprising a tubular body with its attaching flange axially-inwardly disposed therein and said cap comprising a tubular body which is inserted into said spout tubular body and which carries its barrier layer at an axially-inwardly disposed position, said spout attaching flange extending radially inwardly and the barrier layer on the cap contacting the outer surface of said radially inwardly-extending flange.

* * * * *